US010403185B2

(12) United States Patent
Jensen

(10) Patent No.: US 10,403,185 B2
(45) Date of Patent: Sep. 3, 2019

(54) SIGNAGE SUPPORT FOR VEHICLE TIRES

(71) Applicant: Chariot Concepts LLC, Yuba City, CA (US)

(72) Inventor: Dannie R. Jensen, Yuba City, CA (US)

(73) Assignee: Chariot Concepts LLC, Yuba City, CA (US)

( * ) Notice: Subject to any disclaimer, the term of this patent is extended or adjusted under 35 U.S.C. 154(b) by 228 days.

(21) Appl. No.: 15/677,203

(22) Filed: Aug. 15, 2017

(65) Prior Publication Data

US 2018/0053447 A1 Feb. 22, 2018

Related U.S. Application Data

(60) Provisional application No. 62/375,859, filed on Aug. 16, 2016.

(51) Int. Cl.

| | |
|---|---|
| ***G09F 21/04*** | (2006.01) |
| ***G09F 3/20*** | (2006.01) |
| *A47F 7/04* | (2006.01) |

(52) U.S. Cl.

CPC ..... *G09F 21/043* (2013.01); *G09F 3/20* (2013.01); *G09F 21/045* (2013.01); *A47F 7/04* (2013.01); *G09F 21/04* (2013.01)

(58) Field of Classification Search

CPC ..... G09F 21/043; G09F 21/045; G09F 21/04; G09F 3/20; A47F 7/04

USPC ..... 40/587; 248/285.1, 172

See application file for complete search history.

(56) References Cited

U.S. PATENT DOCUMENTS

| | | | | |
|---|---|---|---|---|
| 1,309,464 | A * | 7/1919 | Dencklau | G09F 21/045 40/587 |
| 1,388,848 | A | 8/1921 | Carter | |
| 1,702,469 | A | 2/1929 | Epstein | |
| 1,733,918 | A * | 10/1929 | Spotswood | G09F 21/04 296/37.3 |
| 2,632,268 | A * | 3/1953 | Schroeder | G09F 21/045 40/587 |
| 2,660,823 | A | 12/1953 | Dubin | |
| 2,820,626 | A * | 1/1958 | Hedeen | B25B 27/00 248/354.5 |
| 2,882,608 | A * | 4/1959 | Tursman | G01B 11/275 248/205.1 |
| 2,931,511 | A | 4/1960 | Crum | |
| 3,141,252 | A | 7/1964 | Mullen | |

(Continued)

OTHER PUBLICATIONS

Photos of Michelin Advertising Insert; Mar. 1, 1996.

(Continued)

*Primary Examiner* — Eret C McNichols

(74) *Attorney, Agent, or Firm* — Neustel Law Offices

(57) ABSTRACT

A signage support for vehicle tires for attaching objects such as signage to the sidewall area of unmounted vehicle tires. The signage support for vehicle tires generally includes a cross member having a first end and a second end, a first connector attached to the first end and a second connector attached to the second end. The first connector and second connector are configured to connect to the inner edge of the side opening of a vehicle tire. The cross member is configured to extend or retract to allow for connection to various sizes and types of vehicle tires. Signage or other objects are attached to the cross member or extended members extending from the connectors.

20 Claims, 7 Drawing Sheets

(56) References Cited

U.S. PATENT DOCUMENTS 3,298,121 A 1/1967 Wathen
3,355,136 A * 11/1967 Staples ..... F16M 11/046 248/352
3,426,463 A 2/1969 Weisenbach
3,494,057 A 2/1970 Ford
3,547,258 A * 12/1970 Black ..... A47B 45/00 206/304
3,864,860 A 2/1975 Merzweiler
3,990,666 A * 11/1976 Morrison ..... G01B 5/0025 248/205.1
4,678,239 A * 7/1987 Matsushita ..... B60B 7/20 301/37.25
5,072,536 A * 12/1991 Matthews ..... G09F 21/045 301/37.102
5,213,297 A * 5/1993 Laskowski ..... A47F 7/04 211/23
5,215,288 A * 6/1993 Lyon ..... B60P 7/15 254/113
6,457,689 B1 * 10/2002 Padiak ..... G09F 3/20 248/214
6,736,371 B1 * 5/2004 Burrows ..... B60P 7/15 254/114
8,090,561 B1 * 1/2012 Shin ..... G06Q 30/06 345/207
8,650,783 B2 * 2/2014 Brown ..... G09F 15/0062 116/63 P
2005/0039365 A1 2/2005 Rosa
2005/0040296 A1 * 2/2005 Rosa ..... A47F 7/04 248/124.1
2010/0170123 A1 * 7/2010 DoVale, Jr. ..... G09F 21/043 40/587
2011/0170276 A1 * 7/2011 Astill ..... G03B 15/06 362/16
2013/0008066 A1 * 1/2013 de Martigny ..... A47F 7/04 40/606.03
2015/0083673 A1 * 3/2015 Mansor ..... A47F 7/04 211/23
2015/0096947 A1 * 4/2015 Shaw ..... B66F 7/28 211/23
2016/0316937 A1 * 11/2016 Minami ..... A47F 7/04

OTHER PUBLICATIONS

Photos of Single Band Tire Advertising Insert; May 19, 2016.
Photos of Uninstalled Tire Advertising Insert; Jul. 5, 2016.
Photo of Outdoor Tire Display with Insert Installed; Jul. 5, 2016.
Photos of Goodyear Advertising Insert; Jul. 17, 2016.

* cited by examiner

SIGNAGE SUPPORT FOR VEHICLE TIRES

CROSS REFERENCE TO RELATED APPLICATIONS

I hereby claim benefit under Title 35, United States Code, Section 119(e) of U.S. provisional patent application Ser. No. 62/375,859 filed Aug. 16, 2016. The 62/375,859 application. The 62/375,859 application is hereby incorporated by reference into this application.

STATEMENT REGARDING FEDERALLY SPONSORED RESEARCH OR DEVELOPMENT

Not applicable to this application.

BACKGROUND

Field

Example embodiments in general relate to a signage support for vehicle tires for attaching objects such as signage to the sidewall area of unmounted vehicle tires.

Related Art

Any discussion of the related art throughout the specification should in no way be considered as an admission that such related art is widely known or forms part of common general knowledge in the field.

Automotive tire retailers often times will display tires with the sidewall facing toward a potential buyer. Examples of conventional methods of displaying tires including hanging tires on a wall, standing tires up with a tire stand, vertically standing a tire on top of a stack of tires and the like. The tires are sometimes displayed while mounted on a rim and other times displayed without mounting on a rim. Tire retailers will often times attached signage, messages or other objects within the opening in the tire using conventional mounting systems such as taping the signage to the tire. However, conventional mounting systems can suffer from poor attachment resulting in undesirable drooping and movement of the signage particularly in outdoor conditions.

SUMMARY

An example embodiment is directed to a signage support for vehicle tires. The signage support for vehicle tires includes a cross member having a first end and a second end, a first connector attached to the first end and a second connector attached to the second end. The first connector and second connector are configured to connect to the inner edge of the side opening of a vehicle tire. The cross member is configured to extend or retract to allow for connection to various sizes and types of vehicle tires. Signage or other objects are attached to the cross member or extended members extending from the connectors.

There has thus been outlined, rather broadly, some of the embodiments of the signage support for vehicle tires in order that the detailed description thereof may be better understood, and in order that the present contribution to the art may be better appreciated. There are additional embodiments of the signage support for vehicle tires that will be described hereinafter and that will form the subject matter of the claims appended hereto. In this respect, before explaining at least one embodiment of the signage support for vehicle tires in detail, it is to be understood that the signage support for vehicle tires is not limited in its application to the details of construction or to the arrangements of the components set forth in the following description or illustrated in the drawings. The signage support for vehicle tires is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

Figures 1, 2, 3, 4:
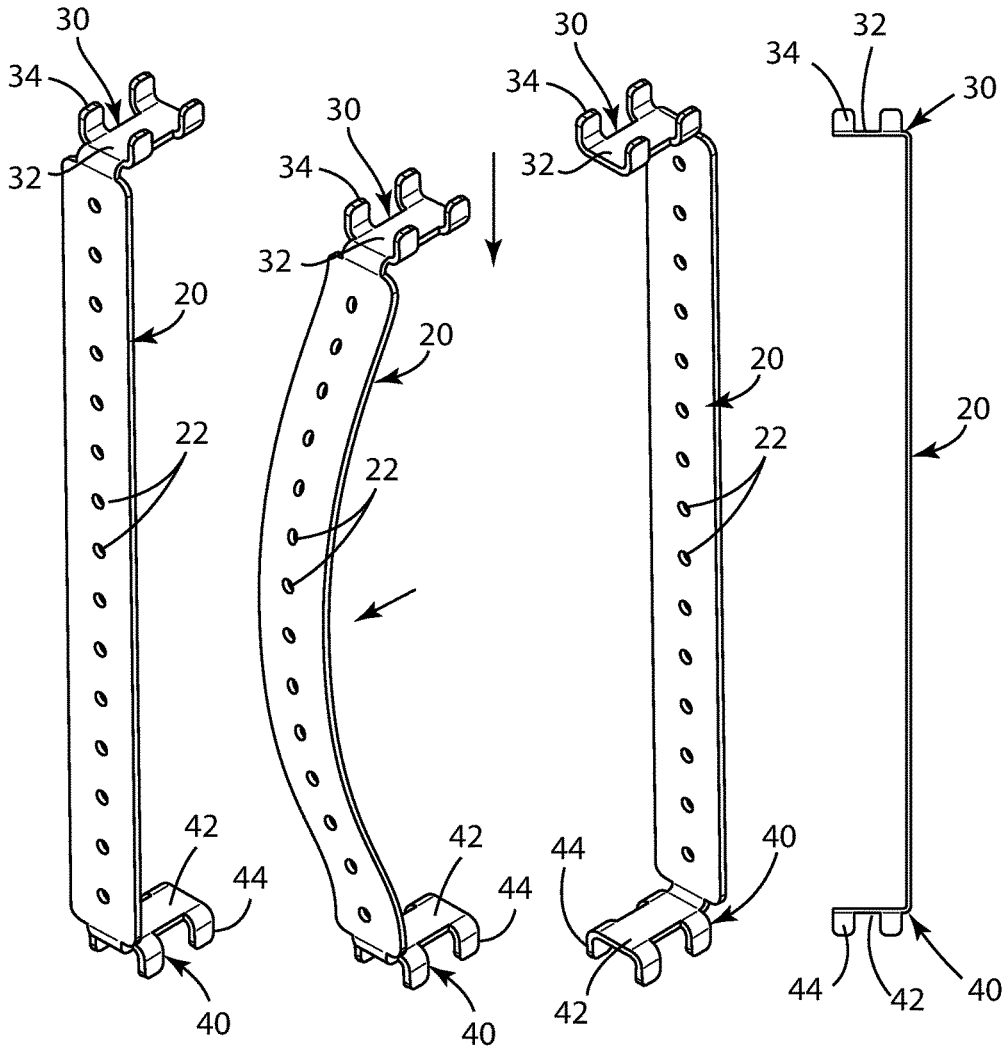
FIG. 1 is a front upper perspective view of a signage support for vehicle tires in accordance with an example embodiment.
FIG. 2 is a front upper perspective view of a signage support for vehicle tires being bent in accordance with an example embodiment.
FIG. 3 is a rear upper perspective view of a signage support for vehicle tires in accordance with an example embodiment.
FIG. 4 is a side view of a signage support for vehicle tires in accordance with an example embodiment.

An example signage support for vehicle tires generally comprises a cross member 20 having a first end and a second end, a first connector 30 attached to the first end and a second connector 40 attached to the second end. The first connector 30 and second connector 40 are configured to connect to the inner edge 12 of the side opening of a vehicle tire 10. The cross member 20 is configured to extend or retract to allow for connection to various sizes and types of vehicle tires 10. The various embodiments of the invention are designed to removably attach to an unmounted tire 10 that is not mounted on a rim. The various embodiments of the invention are further designed to removably attach to the inner edge 12 (e.g. face of the bead) of the sidewall opening of the tire 10. The various embodiments of the invention are capable of being used upon various sizes of tires 10 having different diameter of sidewall openings and various thicknesses of sidewalls. The various embodiments of the invention are also capable of being used in an indoor and outdoor environment. The various embodiments of the invention further allow for the attachment of safety and security apparatus (e.g. straps) on the tire 10 being interface with.

Signage or other objects 14 are attached to the cross member 20 or extended members extending from the connectors. The various embodiments of the invention may be used to support (temporarily or permanently) and display various objects 14 near the sidewall opening of the tire 10 such as, but not limited to, signage, advertisements, promotions, messages, information, contact information, decorations and the like. For example, the object 14 may be comprised of an advertisement disc being a circular sheet of paperboard that is approximately the size of the sidewall opening of the tire 10 and that includes an advertisement printed on one side of the circular sheet. Various other types of objects 14 may be supported by the various embodiments of the invention. Furthermore, one or more objects 14 may be supported simultaneously by the various embodiments of the invention on a single tire 10. In addition, two or more of the various embodiments of the invention may be attached to one or both inner edges 12 of the sidewall opening of the tire 10 thereby allowing multiple objects 14 to be displayed on one or both sides of the tire 10. In addition, the various embodiments of the invention may be used on tires 10 that are displayed at a retail store or other locations in various manners such as, but not limited to, tires 10 hung on a wall, tires 10 vertically standing up within a stand, tires 10 vertically standing on top of a stack of tires 10 and various other manners. Also, the various embodiments may be used upon a tire 10 that is vertical, horizontal or angled.

B. Cross Member

The cross member 20 has a first end and a second end defining a length that is preferably substantially equal to the diameter of the sidewall opening of the tire 10 but may be greater or less in length than the diameter of the sidewall opening of the tire 10. The cross member 20 is preferably in a straight state in the initial position but may be curved or angular in the initial position. The cross member 20 may be comprised of various types of materials such as plastic, metal, composite and the like. The cross member 20 may also be comprised of a rigid structure, bendable structure or a resilient flexible structure. The cross member 20, the first connector 30 and the second connector 40 may be comprised of separately connected structures (e.g. FIG. 11) or a unitary structure (e.g. FIGS. 1 and 12). The cross member 20 may have various cross sectional shapes such as, but not limited to, rectangular, circular, oval and the like. The cross member 20 may also have a flat structure as illustrated in FIGS. 1 through 5B, 12 and 13 of the drawings. The cross member 20 may also have a planar surface on the outside to allow for attachment and broad support of an object 14 as shown in FIGS. 1 through 3, 12 and 13 of the drawings.

The cross member 20 may be configured to allow for attachment of an object 14 directly to the cross member 20. Various methods of attachment may be used for attaching the object 14 to the cross member 20 such as, but not limited to, adhesive, tape, glue, fasteners, mechanical fasteners 50 (e.g. screws, bolts, clips, knobs, push-type retainers, ribbed push-in rivets, plastic retainers, threaded fasteners, and the like), wire, straps, rope, string, tie straps, zip ties and the like. For example, the cross member 20 may include one or more connecting apertures 22 as illustrated in FIGS. 1 through 3 of the drawings. The connecting apertures 22 may be equidistantly spaced apart or spaced apart at different distances. The connecting apertures 22 preferably extending along a substantial length of the cross member 20 as shown in FIGS. 1 through 3, but the connecting apertures 22 may alternatively only extend along a portion of the cross member 20. The connecting apertures 22 are adapted to receive one or more mechanical fasteners 50 or other fastener (e.g. wire, strap). The object 14 may alternatively (or in addition to mechanical fasteners 50) be attached with adhesive, tape, glue or other non-mechanical type of fastener.

The cross member 20 is configured to be adjustable in length to accommodate different sizes of side openings in the unmounted tire 10. The cross member 20 may be adjustable in length by being comprised of a flexible structure and/or flexible material to allow for flexing, bending and straightening of the cross member 20 as illustrated in the embodiments shown in FIGS. 1 through 7, 12 and 13. The cross member 20 may be adjustable in length by being comprised of a telescoping structure as illustrated in the embodiments shown in FIGS. 8 through 11.

FIGS. 1 through 7, 12 and 13 illustrate embodiments wherein the cross member 20 is comprised of a single structure that is bendable and/or resiliently flexible to allow for adjusting the distance between the first end and the second end of the cross member 20 to accommodate various diameters of sidewall openings in tires 10. To reduce the length of the cross member 20 in these embodiments, the user bends the middle portion of the cross member 20 outwardly or inwardly thereby reducing the distance between the first end and the second of the cross member 20 to allow for insertion into the sidewall opening of the tire 10 as shown in FIGS. 2, 5A, 7 and 13. To increase the length of the cross member 20, the user either allows the cross member 20 to flex back to its initial shape or bends the cross member 20 back to a substantially straight shape thereby causing the connectors 30, 40 to frictionally engage the inner edge 12 of the tire 10 as shown in FIGS. 1, 3, 4, 5B through 5D, 6 and 12.

FIGS. 8 through 11 illustrate embodiments wherein the cross member 20 is comprised of a telescopic device that telescopes to various lengths to accommodate various diameters of sidewall openings in tires 10. The telescopic device includes a first telescoping member 24 and a second telescoping member 26 adjustably connected to the first telescoping member 24. The telescopic device may include a spring that applies an outward biasing force to the first telescoping member 24 and the second telescoping member 26 extended outwardly toward the opposing sides of the inner edge 12 of the tire 10.

The telescopic device may alternatively include a locking member 28 (e.g. threaded fastener) that is adapted to selectively lock a position of the first telescoping member 24 with respect to the second telescoping member 26 as further illustrated in FIGS. 8 through 11. In addition to the locking member 28, the biasing spring may also be used to assist in ensuring that the first telescoping member 24 and the second telescoping member 26 are fully extended when inside of the inner edge 12 of the tire 10. The user compresses the telescopic device to shorten the effective distance between the first connector 30 and the second connector 40 prior to insertion into the sidewall opening of the tire 10. After the first connector 30 and second connector 40 are aligned with the inner edge 12 of the sidewall opening of the tire 10, the user then expands the length of the telescopic device until the first connector 30 and the second connector 40 are snugly engaging the opposing portions of the inner edge 12 of the tire 10. The object 14, such as signage, is then attached to the cross member 20 and/or the connectors 30, 40.

C. First and Second Connectors

Figure 5A:
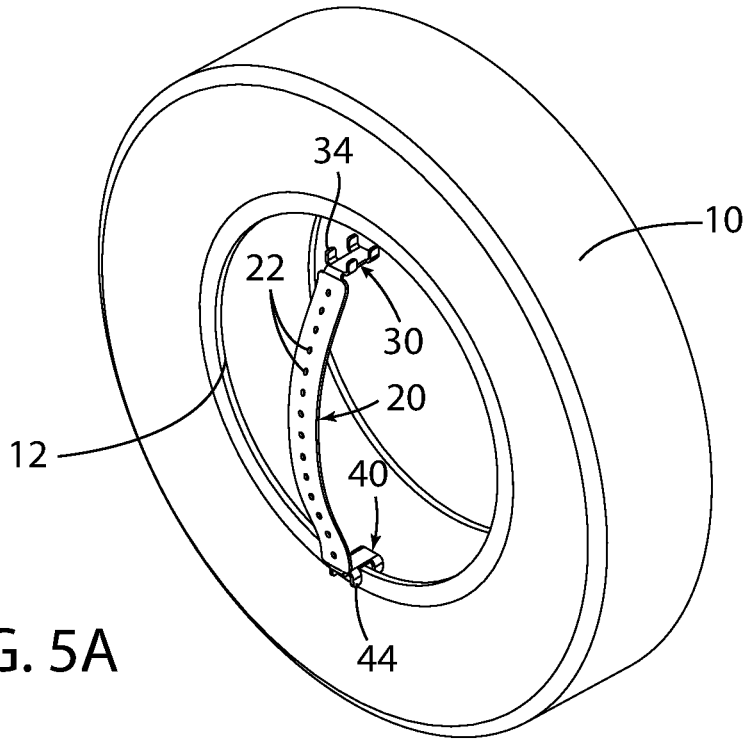
FIG. 5A is a front upper perspective view of a signage support for vehicle tires being bent for insertion into the opening of the tire in accordance with an example embodiment.
Figure 5B:
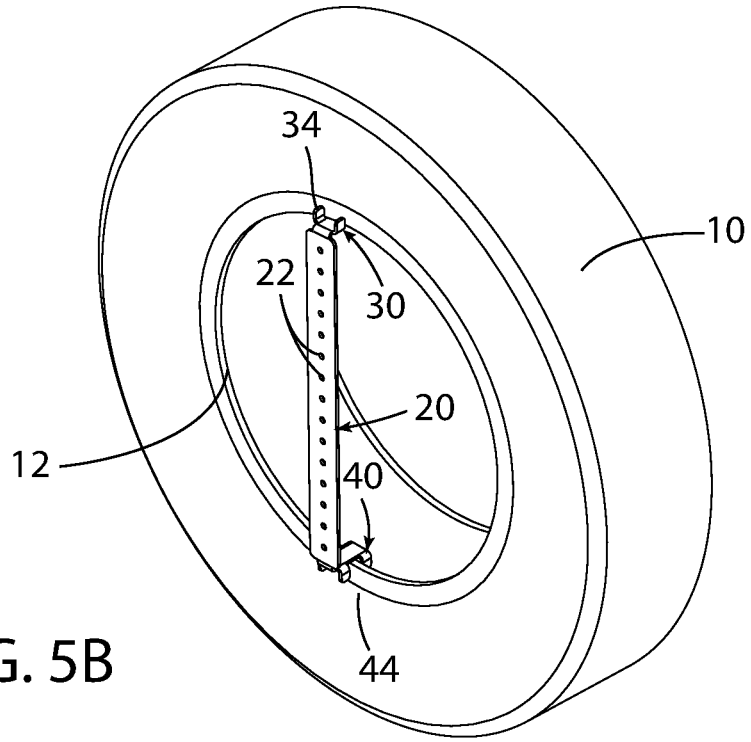
FIG. 5B is a front upper perspective view of a signage support for vehicle tires attached within the opening of the tire in accordance with an example embodiment.
Figure 5C:
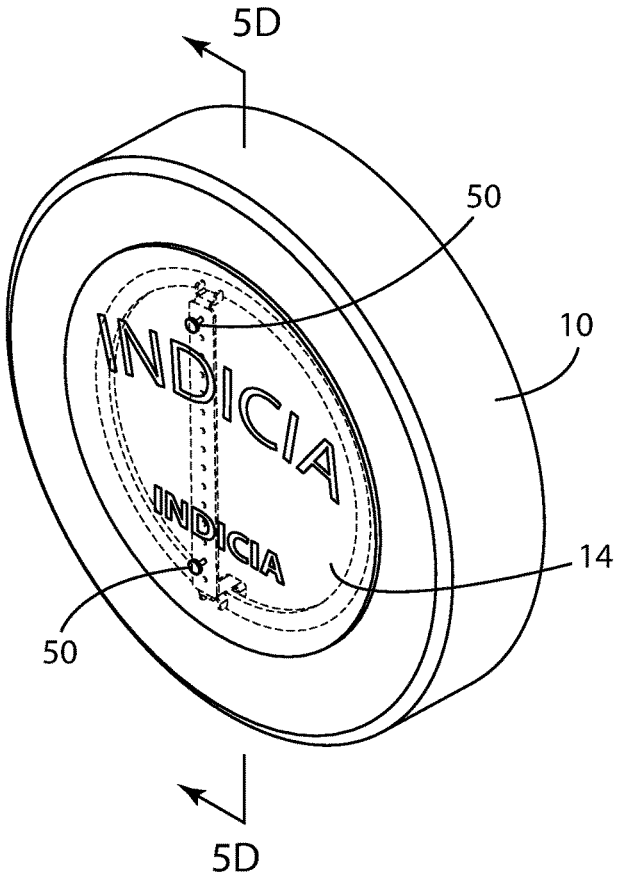
FIG. 5C is a front upper perspective view of a signage support for vehicle tires attached within the opening of the tire and supporting signage in accordance with an example embodiment.
Figure 5D:
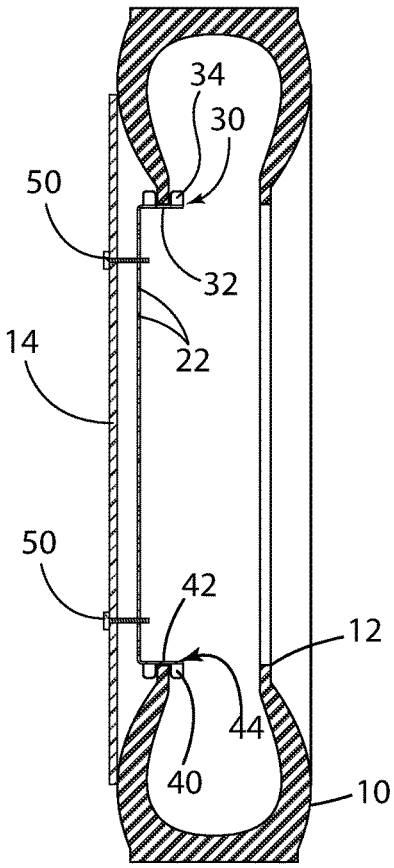
FIG. 5D is a cross sectional view taken along line 5D-5D of FIG. 5C.
Figure 6:
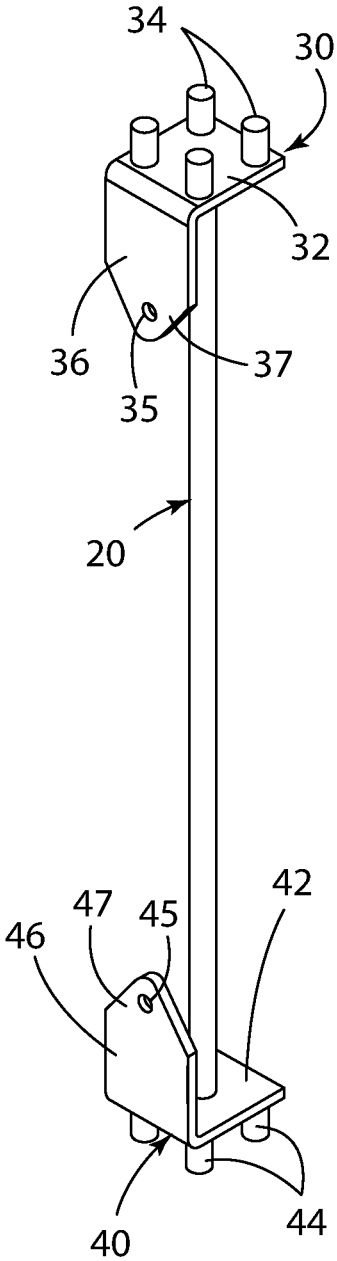
FIG. 6 is a front upper perspective view of a signage support for vehicle tires in accordance with another example embodiment.
Figure 7:
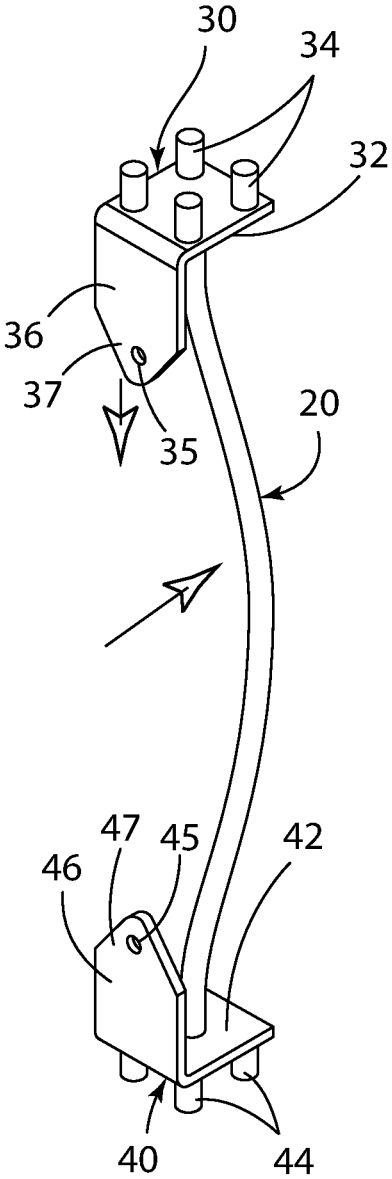
FIG. 7 is a front upper perspective view of a signage support for vehicle tires with the cross member bent in accordance with another example embodiment.
Figure 8:
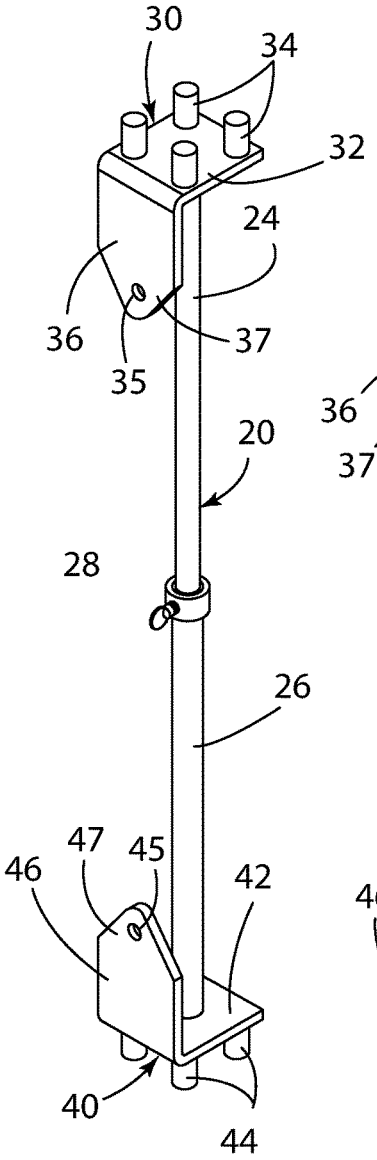
FIG. 8 is a front upper perspective view of a signage support for vehicle tires in accordance with another example embodiment.
Figure 9:
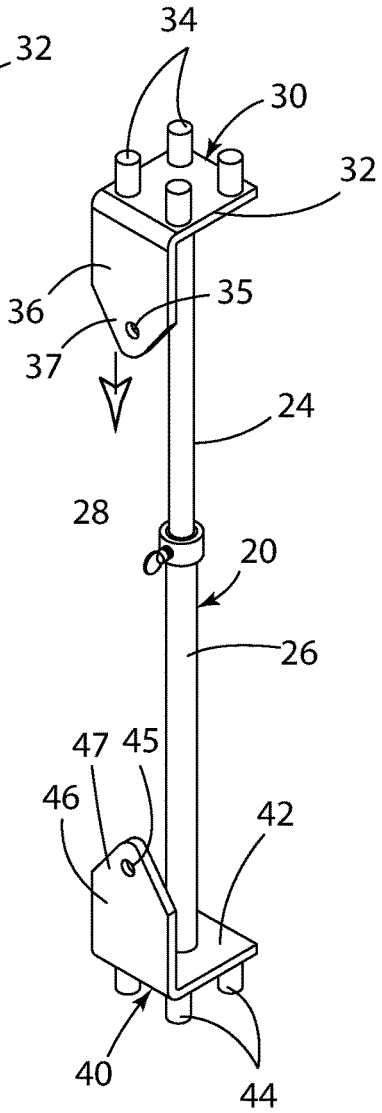
FIG. 9 is a front upper perspective view of a signage support for vehicle tires with the cross member contracted in accordance with another example embodiment.
Figure 10:
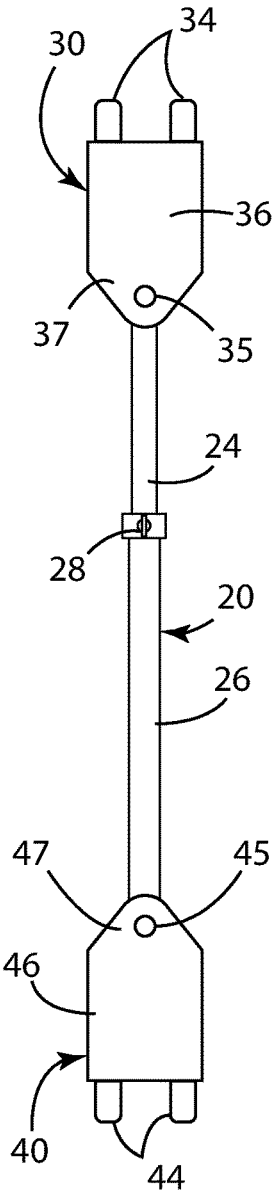
FIG. 10 is a front view of the signage support for vehicle tires in accordance with an example embodiment.
Figure 11:
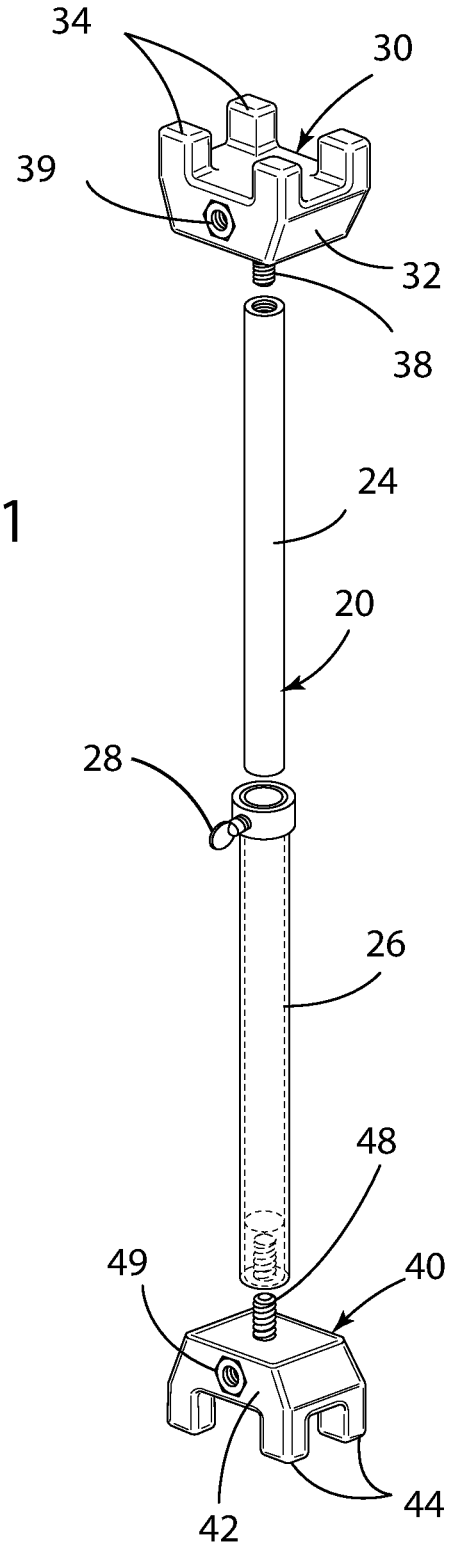
FIG. 11 is a front upper perspective view of a signage support for vehicle tires in accordance with another example embodiment.

A first connector 30 extends from the first end of the cross member 20 and a second connector 40 extends from the second end of the cross member 20. The connectors preferably are comprised of mirrored structures but may have different structures. The connectors 30, 40 are each configured to removably connect to an opposing portion of the inner edge 12 of the side opening of an unmounted tire 10 as illustrated in FIGS. 5B through 5D of the drawings. The connectors 30, 40 may be permanently attached to the cross member 20 or removably connected. FIG. 11 illustrates in one embodiment the usage of threaded members 38, 48 extending from the connectors 30, 40 to threadably engage threaded receptacles in the distal ends of the cross member 20.

The first connector 30 preferably includes a first member 32 that preferably extends substantially transversely or orthogonally from the first end of the first connector 30. The first connector 30 may extend rearwardly from the cross member 20 as illustrated in FIGS. 1 through 5B of the drawings or the first connector 30 may be substantially concentrically positioned with respect to the cross member 20 as illustrated in FIGS. 6 through 10 of the drawings. The first connector 30 may include a first threaded receptacle 39 to receive a mechanical fastener 50 for securing the object 14 as illustrated in FIG. 11.

Figure 12:
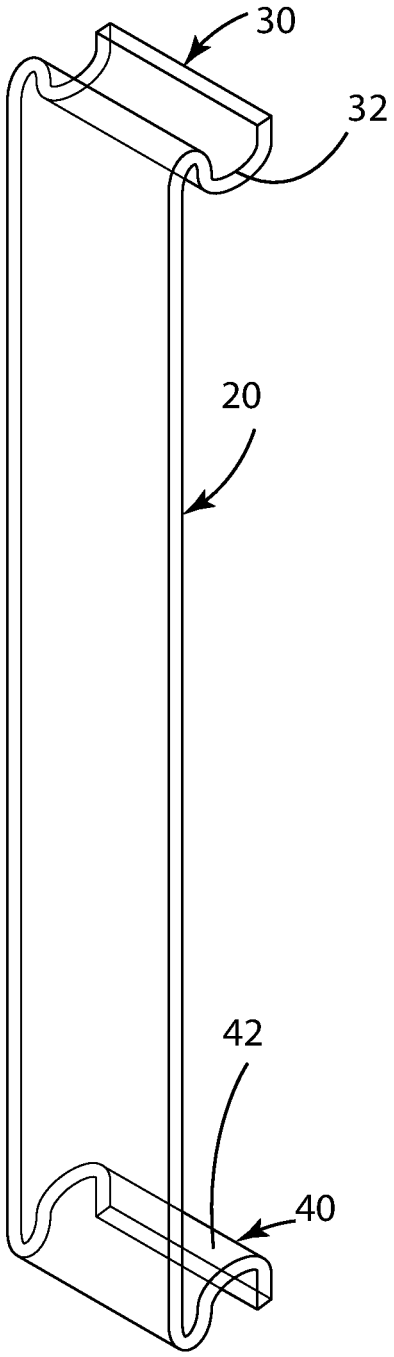
FIG. 12 is a front upper perspective view of a signage support for vehicle tires in accordance with another example embodiment.
Figure 13:
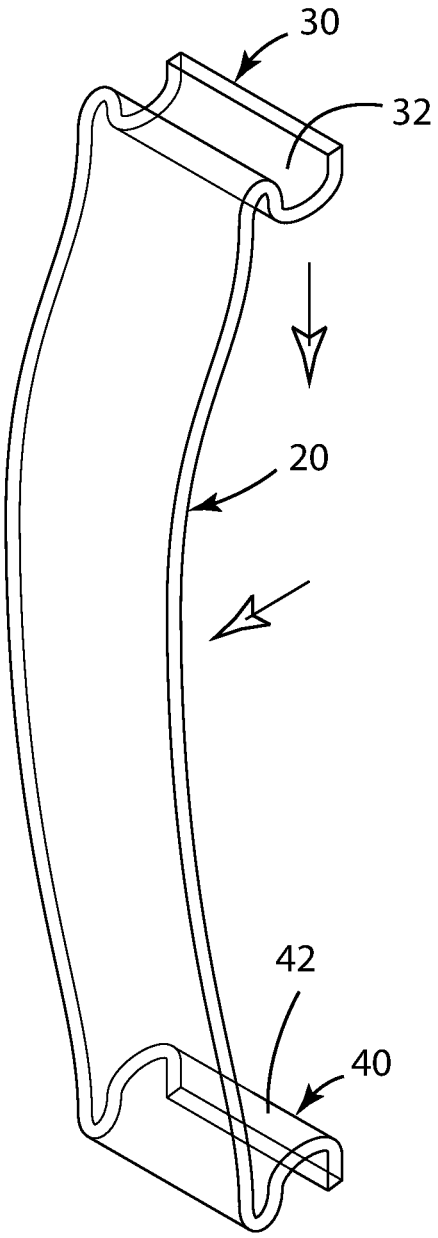
FIG. 13 is a front upper perspective view of a signage support for vehicle tires with the cross member bent in accordance with another example embodiment.

The first member 32 is configured to securely engage the inner edge 12 of the tire 10. FIGS. 12 and 13 illustrate the first member 32 having a C-shaped structure defining a passage that receives the inner edge 12 of the tire 10. Various other shapes may be used to define the passage (e.g. V-shaped and the like).

FIGS. 1 through 11 illustrate an alternative embodiment where the first member 32 includes a plurality of first teeth 34 (e.g. tabs, knobs, extended members) that extend outwardly from the first member 32. The first teeth 34 may have various cross sectional shapes and may extend outwardly at various distances. The first teeth 34 define a first path configured to receive a portion of the inner edge 12 of the unmounted tire 10 thereby preventing rotation of the first connector 30 with respect to the tire 10 when attached to the tire 10. FIGS. 1 through 11 illustrate the usage of two inner first teeth 34 and two outer first teeth 34 wherein the passage is defined between thereof. The distance between the two inner first teeth 34 and the two outer first teeth 34 is preferably large to allow for receiving of the inner edge 12 of the tire 10 but narrow enough to prevent significant rotation of the first connector 30 with respect to the inner edge 12 of the tire 10.

The first connector 30 may also include a first extended member 36 that extends downwardly from the first member 32 wherein the first extended member 36 is substantially parallel with respect to the cross member 20. The first extended member 36 preferably has a flat planar surface sufficient to attach the object 14 with adhesive, glue or tape. In addition, the first extended member 36 includes a first tapered portion 37. The first extended member 36 may include one or more first apertures 35 to receive a mechanical fastener 50 or other type of fasteners for securing the object 14 to the first extended member 36 in addition to or instead of adhesive, glue or tape.

The second connector 40 preferably includes a second member 42 that preferably extends substantially transversely or orthogonally from the second end of the second connector 40. The second connector 40 may extend rearwardly from the cross member 20 as illustrated in FIGS. 1 through 5B of the drawings or the second connector 40 may be substantially concentrically positioned with respect to the cross member 20 as illustrated in FIGS. 6 through 10 of the drawings. The second connector 40 may include a second threaded receptacle 49 to receive a mechanical fastener 50 for securing the object 14 as illustrated in FIG. 11.

The second member 42 is configured to securely engage the inner edge 12 of the tire 10. FIGS. 12 and 13 illustrate the second member 42 having a C-shaped structure defining a passage that receives the inner edge 12 of the tire 10. Various other shapes may be used to define the passage (e.g. V-shaped and the like).

FIGS. 1 through 11 illustrate an alternative embodiment where the second member 42 includes a plurality of second teeth 44 that extend outwardly from the second member 42. The second teeth 44 may have various cross sectional shapes and may extend outwardly at various distances. The second teeth 44 define a second path configured to receive a portion of the inner edge 12 of the unmounted tire 10 thereby preventing rotation of the second connector 40 with respect to the tire 10 when attached to the tire 10. FIGS. 1 through 11 illustrate the usage of two inner second teeth 44 and two outer second teeth 44 wherein the passage is defined between thereof. The distance between the two inner second teeth 44 and the two outer second teeth 44 is preferably large to allow for receiving of the inner edge 12 of the tire 10 but narrow enough to prevent significant rotation of the second connector 40 with respect to the inner edge 12 of the tire 10.

The second connector 40 may also include a second extended member 46 that extends downwardly from the second member 42 wherein the second extended member 46 is substantially parallel with respect to the cross member 20. The second extended member 46 preferably has a flat planar surface sufficient to attach the object 14 with adhesive, glue or tape. In addition, the second extended member 46 includes a second tapered portion 47. The second extended member 46 may include one or more second apertures 45 to receive a mechanical fastener 50 or other type of fasteners for securing the object 14 to the second extended member 46 in addition to or instead of adhesive, glue or tape.

FIG. 11 illustrates the usage of teeth 34, 44 that define a passage for the inner edge 12 of the tire 10 and a second passage that allows for straddling of a lash strap that engages the inner edge 12 of the tire 10 at 90 degrees to the inner edge 12. By straddling the lash strap used to secure the tire 10, the connectors 30, 40 are further prevented from moving or rotating.

D. Operation of Preferred Embodiment

In use, the user reduces the effective length of the cross member 20 (e.g. by bending, flexing or contracting) prior to attaching to the inner edge 12 of the tire 10 to allow for the connectors 30, 40 to pass through the sidewall opening of the tire 10. Once the cross member 20 is reduced in length, the user then positions the connectors 30, 40 adjacent to the opposing portions of the inner edge 12 of the tire 10 and then expands the cross member 20 (e.g. bending, allowing to return to original state or expanding) until the connectors 30, 40 are fully engaged with the inner edge 12 in a manner that prevents movement of the connectors 30, 40 with respect to the tire 10. The inner teeth 34, 44 are positioned adjacent the inside of the inner edge 12 and the outer teeth 34, 44 are positioned adjacent the outside of the inner edge 12. Tension from the cross member 20 ensures that the connectors 30, 40 remain in constant frictional contact with the inner edge 12 of the tire 10 to prevent movement or twisting of the connectors 30, 40 over extended periods of time or outdoor environmental conditions. The user then attaches the object 14 (e.g. disc advertisement) to the one or more of the connectors 30, 40 and/or to the cross member 20 using one or more fasteners (e.g. tape, adhesive, glue, mechanical fastener 50, string, rope, wire and the like). The tire 10 may then displayed vertically, at an angle or horizontally so that the object 14 is displayed to the public for viewing in a secure manner. The user may change the object 14 at any time and may also remove the invention from the tire 10 at any time once there is no further need for the display of the tire 10 with the object 14.

Unless otherwise defined, all technical and scientific terms used herein have the same meaning as commonly understood by one of ordinary skill in the art to which this invention belongs. Although methods and materials similar to or equivalent to those described herein can be used in the practice or testing of the signage support for vehicle tires, suitable methods and materials are described above. All publications, patent applications, patents, and other references mentioned herein are incorporated by reference in their entirety to the extent allowed by applicable law and regulations. The signage support for vehicle tires may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An object support device for a tire for supporting an object near the sidewall opening in an unmounted tire, comprising:

a cross member having a first end and a second end, wherein the cross member is configured to be adjustable in length to accommodate different sizes of side openings in an unmounted tire;

a first connector extending from the first end of the cross member, wherein the first connector is configured to removably connect to an inner edge of the side opening of the unmounted tire;

a second connector attached to the second end of the cross member, wherein the second connector is configured to removably connect to the inner edge of the side opening of the unmounted tire opposite of the first connector; and a first extended member extending from the first connector and a second extended member extending from the second connector, wherein the first extended member extends toward the second extended member and wherein the second extended member extends toward the first extended member.

2. The object support device for a tire of claim 1, wherein the cross member has a length less than the diameter of the opening in the unmounted tire.

3. The object support device for a tire of claim 1, wherein the cross member has a length greater than the diameter of the opening in the unmounted tire.

4. The object support device for a tire of claim 1, wherein the cross member is configured to allow for attachment of an object to the cross member.

5. The object support device for a tire of claim 1, wherein the cross member includes at least one connecting aperture.

6. The object support device for a tire of claim 1, wherein the cross member includes a plurality of connecting apertures.

7. The object support device for a tire of claim 6, wherein the plurality of connecting apertures are equidistantly spaced apart.

8. The object support device for a tire of claim 1, wherein the cross member is comprised of a flexible material.

9. The object support device for a tire of claim 8, wherein the cross member is comprised of plastic.

10. The object support device for a tire of claim 1, wherein the cross member is comprised of a telescopic device.

11. The object support device for a tire of claim 10, wherein the telescopic device includes a first telescoping member and a second telescoping member adjustably connected to the first telescoping member.

12. The object support device for a tire of claim 11, wherein the telescopic device includes a spring that applies an outward biasing force to the first telescoping member and the second telescoping member.

13. The object support device for a tire of claim 11, wherein the telescopic device includes a locking member, wherein the locking member is adapted to lock a position of the first telescoping member with respect to the second telescoping member.

14. The object support device for a tire of claim 1, wherein the cross member, the first connector and the second connector are comprised of a unitary structure.

15. The object support device for a tire of claim 1, wherein the first connector includes a plurality of first teeth and wherein the second connector includes a plurality of second teeth.

16. The object support device for a tire of claim 15, wherein the plurality of first teeth define a first path configured to receive a portion of the inner edge of the unmounted tire and wherein the plurality of second teeth define a second path configured to receive a portion of the inner edge of the unmounted tire.

17. The object support device for a tire of claim 1, wherein the first connector and the second connector extend rearwardly from the cross member.

18. The object support device for a tire of claim 1, wherein the first connector and the second connector are substantially concentrically positioned with respect to the cross member.

19. The object support device for a tire of claim 1, including a first aperture extending through the first extended member and a second aperture extended through the second extended member.

20. An object support device for a tire for supporting an object near the sidewall opening in an unmounted tire, comprising:

a cross member having a first end and a second end, wherein the cross member is configured to be adjustable in length to accommodate different sizes of side openings in an unmounted tire;

a first connector extending from the first end of the cross member, wherein the first connector is configured to removably connect to an inner edge of the side opening of the unmounted tire;

a second connector attached to the second end of the cross member, wherein the second connector is configured to removably connect to the inner edge of the side opening of the unmounted tire opposite of the first connector;

a first extended member extending from the first connector and a second extended member extending from the second connector, wherein the first extended member extends toward the second extended member and wherein the second extended member extends toward the first extended member; and a first aperture extending through the first extended member and a second aperture extended through the second extended member;

wherein the first connector includes a plurality of first teeth and wherein the second connector includes a plurality of second teeth.

* * * * *